US011466832B2

(12) United States Patent
Zhang et al.

(10) Patent No.: US 11,466,832 B2
(45) Date of Patent: Oct. 11, 2022

(54) MOUNTING STRUCTURE OF PRIMARY OPTICAL ELEMENT FOR VEHICLE HEADLAMP, VEHICLE LAMP AND VEHICLE

(71) Applicant: HASCO VISION TECHNOLOGY CO., LTD., Shanghai (CN)

(72) Inventors: Dapan Zhang, Shanghai (CN); He Zhu, Shanghai (CN); Zhiping Qiu, Shanghai (CN); Xiaofen Sun, Shanghai (CN); Hui Li, Shanghai (CN); Rui Nie, Shanghai (CN); Cong Li, Shanghai (CN)

(73) Assignee: HASCO VISION TECHNOLOGY CO., LTD, Shanghai (CN)

( * ) Notice: Subject to any disclaimer, the term of this patent is extended or adjusted under 35 U.S.C. 154(b) by 0 days.

(21) Appl. No.: 17/275,496

(22) PCT Filed: Oct. 23, 2019

(86) PCT No.: PCT/CN2019/112841
§ 371 (c)(1),
(2) Date: Mar. 11, 2021

(87) PCT Pub. No.: WO2020/083321
PCT Pub. Date: Apr. 30, 2020

(65) Prior Publication Data

US 2022/0120403 A1 Apr. 21, 2022

(30) Foreign Application Priority Data

Oct. 25, 2018 (CN) ..... 201811248104.9
Jan. 29, 2019 (CN) ..... 201910083832.7
(Continued)

(51) Int. Cl.
*F21V 9/00* (2018.01)
*F21S 41/29* (2018.01)
*F21S 41/24* (2018.01)

(52) U.S. Cl.
CPC ..... *F21S 41/29* (2018.01); *F21S 41/24* (2018.01)

(58) Field of Classification Search
CPC .. F21S 41/29; F21S 41/24; F21S 41/19; F21S 41/192; F21S 41/151; F21S 41/153;
(Continued)

(56) References Cited

U.S. PATENT DOCUMENTS

2008/0198574 A1 8/2008 Woodward et al.
2008/0253144 A1* 10/2008 Dolson ..... F21S 41/24 362/547
(Continued)

FOREIGN PATENT DOCUMENTS

CN 102340062 A 2/2012
CN 104373895 A 2/2015
(Continued)

*Primary Examiner* — Omar Rojas Cadima
(74) *Attorney, Agent, or Firm* — Volpe Koenig

(57) ABSTRACT

A mounting structure of a primary optical element for a vehicle headlamp, comprising a primary optical element, a mounting bracket for mounting the primary optical element, and a cover plate connected to the mounting bracket; the primary optical element, the mounting bracket, and the cover plate are provided with positioning limiting structures for limiting the degree of freedom of the primary optical element; the positioning limiting structures comprise an up-down positioning limiting structure provided on the primary optical element, the mounting bracket and the cover plate, as well as a left-right positioning limiting structure and a front-back positioning limiting structure provided on the primary optical element and the mounting bracket. Also
(Continued)

disclosed are a vehicle lamp and a vehicle comprising the mounting structure of a primary optical element for a vehicle headlamp.

21 Claims, 7 Drawing Sheets

(30) Foreign Application Priority Data

Mar. 5, 2019 (CN) ..... 201910164892.1
May 22, 2019 (CN) ..... 201910428378.4

(58) Field of Classification Search
CPC ..... F21S 41/663; F21S 41/143; F21S 41/141; F21Y 2115/10
See application file for complete search history.

(56) References Cited

U.S. PATENT DOCUMENTS

| | | | |
|---|---|---|---|
| 2017/0114976 | A1 | 4/2017 | Beev et al. |
| 2017/0122518 | A1 | 5/2017 | Landcastle et al. |
| 2018/0087736 | A1 | 3/2018 | Joerg et al. |
| 2018/0264994 | A1 | 9/2018 | Stoehr et al. |

FOREIGN PATENT DOCUMENTS

| | | | | |
|---|---|---|---|---|
| CN | 105299562 | A | 2/2016 | |
| CN | 107525005 | A | 12/2017 | |
| CN | 107664290 | A | 2/2018 | |
| CN | 207334613 | U | 5/2018 | |
| CN | 108204570 | A | 6/2018 | |
| CN | 108397743 | A | 8/2018 | |
| CN | 108397746 | A | 8/2018 | |
| CN | 108626677 | A | 10/2018 | |
| CN | 109268774 | A | 1/2019 | |
| CN | 109611780 | A | 4/2019 | |
| CN | 109681838 | A | 4/2019 | |
| CN | 110094687 | A | 8/2019 | |
| CN | 209762930 | U | 12/2019 | |
| DE | 202014104049 | U1 * | 10/2014 | ..... F21K 9/50 |
| EP | 2306074 | A2 | 4/2011 | |
| EP | 2597359 | A2 | 5/2013 | |
| JP | 0568011 | U | 9/1993 | |
| WO | WO-2012059852 | A1 * | 5/2012 | ..... F21S 41/141 |
| WO | WO-2018149407 | A1 * | 8/2018 | ..... B60Q 1/0011 |

* cited by examiner

A — A

MOUNTING STRUCTURE OF PRIMARY OPTICAL ELEMENT FOR VEHICLE HEADLAMP, VEHICLE LAMP AND VEHICLE

This application is a 35 USC § 371 national stage of international application No. PCT/CN2019/112841, which is entitled "MOUNTING STRUCTURE OF PRIMARY OPTICAL ELEMENT FOR VEHICLE HEADLAMP, VEHICLE LAMP AND VEHICLE," was filed Oct. 23, 2019, and claims priority to Chinese Application Nos. 201910428378.4, filed on May 22, 2019; 201910164892.1, filed on Mar. 5, 2019; 201910083832.7, filed on Jan. 29, 2019; and 201811248104.9 filed on Oct. 25, 2018 all of which are incorporated herein by reference as if fully set forth.

FIELD OF THE INVENTION

The present disclosure relates to a vehicle lamp, and particularly relates to a mounting structure of a primary optical element for a vehicle headlamp. In addition, the present disclosure further relates to a vehicle lamp and a vehicle.

BACKGROUND OF THE INVENTION

There are many types of vehicle lamps for existing vehicles, including a low beam, a high beam, a corner lamp, a matrix type high beam illumination system, an adaptive high beam, a signal lamp and the like. In these vehicle lamps, a primary optical element for carrying out light distribution on light emitted by a light source plays a decisive role.

Currently, the primary optical element on the vehicle lamp generally is made of glass, silica gel or plastic which is a transparent material, and the primary optical element can carry out primary light distribution (e.g., focusing, collimation and the like) on the light emitted by the light source, and thus, the primary optical element plays a great role for a lighting effect of the vehicle lamp, and the positioning and mounting reliability of the primary optical element has a great influence on accuracy of the light shape of the vehicle lamp and the lighting effect of the vehicle lamp. Meanwhile, any one part arranged on the primary optical element can generate influences on primary light distribution of the light, and excessive mounting structures and positioning structures can generate more or less influences on a light distributing effect of the primary optical element.

Based on the above reasons, the prior art is difficult to effectively ensure that the primary optical element can achieve a mounting effect with higher accuracy and higher stability without adding other positioning structures and limiting structures; and the structure is relatively complex, the manufacturing cost is relatively high, and the lighting effect is not ideal.

SUMMARY OF THE INVENTION

The present disclosure firstly is to solve a technical problem of providing a mounting structure of a primary optical element for a vehicle headlamp. The mounting structure of a primary optical element for a vehicle headlamp is simple in structure, convenient and rapid to install, stable in optical performance, low in manufacturing cost and good in lighting effect.

In addition, the present disclosure is also to solve a problem of providing a vehicle lamp. A mounting structure of a primary optical element for a vehicle headlamp in the vehicle lamp is simple in structure, convenient and rapid to install, stable in optical performance, low in manufacturing cost and good in lighting effect.

Further, the present disclosure is also to solve a problem of providing a vehicle. A vehicle lamp of the vehicle is stable in optical performance, low in manufacturing cost and good in lighting effect.

In order to solve the above technical problems, in one aspect, the present disclosure provides a mounting structure of a primary optical element for a vehicle headlamp, including a primary optical element, a mounting bracket for mounting the primary optical element and a cover plate connected with the mounting bracket. A positioning limiting structure for limiting a freedom degree of the primary optical element is arranged on the primary optical element, the mounting bracket and the cover plate. The positioning limiting structure includes: an up-down positioning limiting structure, the up-down positioning limiting structure being arranged on the primary optical element, the mounting bracket and the cover plate so as to facilitate mounting and positioning of the primary optical element and limiting a freedom degree of the primary optical element in an up-down direction; and a left-right positioning limiting structure and a front-back positioning limiting structure, the left-right positioning limiting structure and the front-back positioning limiting structure being arranged on the primary optical element and the mounting bracket so as to facilitate mounting and positioning of the primary optical element and limiting freedom degrees of the primary optical element in a front-back direction and a left-right direction.

As one preferred structure form of the present disclosure, the up-down positioning limiting structure includes a plurality of light guiding bodies arranged at the rear end of the primary optical element, mounting bracket rear positioning faces arranged at the rear end of the mounting bracket, mounting bracket front positioning faces arranged at the front end of the mounting bracket, cover plate rear positioning faces arranged at the rear portion of the cover plate and cover plate front positioning faces arranged at the front portion of the cover plate, the cover plate rear positioning faces and the cover plate front positioning faces are arranged on the same plane, the mounting bracket front positioning faces and the mounting bracket rear positioning faces are arranged on the same plane, the lower surfaces of the front portions of the light guiding bodies abut against the mounting bracket front positioning faces, the lower surfaces of the rear portions of the light guiding bodies abut against the mounting bracket rear positioning faces, the cover plate front positioning faces abut against the upper surfaces of the front portions of the light guiding bodies, and the cover plate rear positioning faces abut against the upper surfaces of the rear portions of the light guiding bodies so as to limit the freedom degree of the primary optical element in the up-down direction.

Optionally, the up-down positioning limiting structure includes a plurality of bosses arranged on the surface of the cover plate close to the primary optical element, the bosses abut against one surface of the primary optical element, and the other surface of the primary optical element abuts against the mounting bracket so as to limit the freedom degree of the primary optical element in the up-down direction.

Further optionally, the up-down positioning limiting structure includes a mounting groove formed on the mounting bracket, and the primary optical element is arranged in the mounting groove and positioned between the mounting bracket and the cover plate so as to limit the freedom degree of the primary optical element in the up-down direction.

As another preferred structure form of the present disclosure, a wedge-shaped gap is formed between each two adjacent light guiding bodies from the rear end to the front end, and the mounting bracket rear positioning faces correspond to the wedge-shaped gaps one to one; the front ends of the light guiding bodies are connected into one whole body, and a positioning rib is arranged or integrally formed in the wedge-shaped gap between each two adjacent light guiding bodies; the left-right positioning limiting structure and the front-back positioning limiting structure include two rear positioning pins arranged on each mounting bracket rear positioning face and in the front-back direction, gaps between every two rear positioning pins arranged in the front-back direction correspond to the positioning ribs one to one, and the positioning ribs are clamped between the two corresponding rear positioning pins and abut against the two corresponding rear positioning pins so as to limit the freedom degree of the primary optical element in the front-back direction; and two opposite faces of each two adjacent light guiding bodies abut against the corresponding rear positioning pins so as to limit the freedom degree of the primary optical element in the left-right direction.

Optionally, two rows of rear positioning pins are arranged on the upper surface and/or the lower surface of the rear portion of the mounting bracket, two front-back adjacent rear positioning pins are arranged in the front-back direction, gaps between every two rear positioning pins arranged in the front-back direction correspond to the positioning ribs one to one, and the positioning ribs are clamped between the two corresponding rear positioning pins and abut against the two corresponding rear positioning pins so as to limit the freedom degree of the primary optical element in the front-back direction; and two opposite faces of each two adjacent light guiding bodies abut against the corresponding rear positioning pins so as to limit the freedom degree of the primary optical element in the left-right direction.

Further optionally, a row of rear positioning pins are arranged at the rear portion of the mounting bracket in the left-right direction, a matching clamping groove structure is arranged at the front portion of the mounting bracket, the matching clamping groove structure is in buckled connection with a flanging protrusion structure arranged at the front portion of the primary optical element, and the rear positioning pins are inserted into the wedge-shaped gaps so as to limit the freedom degrees of the primary optical element in the left-right direction and the front-back direction.

More preferably, the rear positioning pin is of a cone frustum structure or a pyramid frustum structure of which the sectional area of an upper portion is smaller than the sectional area of a lower portion, and a backstop structure is arranged on the surface of each rear positioning pin abutting against the positioning rib.

As one specific structure form of the present disclosure, mounting bracket positioning pins and buckle matching holes are disposed on the left and right sides of the mounting bracket, cover plate positioning holes and buckles are disposed on the left and right sides of the cover plate, the mounting bracket positioning pins correspond to the cover plate positioning holes one to one, and the buckle matching holes correspond to the buckles one to one.

Optionally, mounting bracket positioning pins and cover plate mounting holes are disposed on the left and right sides of the mounting bracket, cover plate positioning holes and cover plate fixing holes are formed in the left and right sides of the cover plate, the mounting bracket positioning pins correspond to the cover plate fixing holes one to one, and the cover plate mounting holes correspond to the cover plate fixing holes one to one.

More specifically, the mounting bracket positioning pin is of a cylinder structure or a cone frustum structure or a cuboid structure or a pyramid frustum structure.

As one specific structure form of the present disclosure, the mounting structure of a primary optical element for a vehicle headlamp according to present disclosure further includes a circuit board, a radiator on which the circuit board is installed and mounting screws; the circuit board is provided with circuit board positioning holes; the radiator is provided with radiator positioning holes; the mounting bracket is provided with circuit board positioning pins; the circuit board positioning pins correspond to the circuit board positioning holes and the radiator positioning holes one to one; and the mounting screws are adapted to fix the mounting bracket and the circuit board onto the radiator.

As another specific structure form of the present disclosure, the primary optical element includes an upper primary optical element and a lower primary optical element, the cover plate includes an upper cover plate and a lower cover plate, the upper primary optical element and the upper cover plate for limiting the upper primary optical element in the up-down direction are sequentially installed on the upper side of the mounting bracket from bottom to top, an inner lamp lens is installed on the upper side of the upper cover plate, and the lower primary optical element and the lower cover plate for limiting the lower primary optical element in the up-down direction are sequentially installed on the lower side of the mounting bracket from top to bottom; and the upper primary optical element and the lower primary optical element each include a plurality of light guiding bodies, wherein the light emergent ends of the light guiding bodies of the upper primary optical element are connected with each other to form an upper light emergent surface, the light emergent ends of the light guiding bodies of the lower primary optical element are connected with each other to form a lower light emergent surface, a light incident surface of the inner lamp lens corresponds to the upper light emergent surface, and the bottom of the inner lamp lens is positioned within a height range of the upper light emergent surface.

More specifically, the up-down positioning limiting structure includes a plurality of bosses formed on the surface of the cover plate close to the primary optical element, the bosses abut against one surface of the primary optical element, and the other surface of the primary optical element abuts against the mounting bracket so as to limit the freedom degree of the primary optical element in the up-down direction.

Further specifically, two rows of rear positioning pins are arranged on the upper surface and/or the lower surface of the rear portion of the mounting bracket, two front-back adjacent rear positioning pins are arranged in the front-back direction, gaps between every two rear positioning pins arranged in the front-back direction correspond to the positioning ribs one to one, and the positioning ribs are clamped between the two corresponding rear positioning pins and abut against the two corresponding rear positioning pins so as to limit the freedom degree of the primary optical element in the front-back direction; and two opposite faces of each two adjacent light guiding bodies abut against the corresponding rear positioning pins so as to limit the freedom degree of the primary optical element in the left-right direction.

As one specific embodiment of the present disclosure, the primary optical element is arranged in an accommodating cavity defined by a circuit board, a lens bracket and a lens with a grid-shaped structure, a radiator is arranged at the rear end of the circuit board, and the primary optical element is installed at the front end of the circuit board.

More specifically, the up-down positioning limiting structure includes a mounting groove formed on the mounting bracket, and the primary optical element is arranged in the mounting groove and positioned between the mounting bracket and the cover plate so as to limit the freedom degree of the primary optical element in the up-down direction.

Further, a row of rear positioning pins are arranged at the rear portion of the mounting bracket in the left-right direction, a matching clamping groove structure is formed at the front portion of the mounting bracket, the matching clamping groove structure is in buckled connection with a flanging protrusion structure arranged at the front portion of the primary optical element, and the rear positioning pins are inserted into the wedge-shaped gaps so as to limit the freedom degrees of the primary optical element in the left-right direction and the front-back direction.

As another specific embodiment of the present disclosure, the mounting structure includes a primary optical system and a secondary projecting system; the primary optical system includes a primary optical element, a mounting bracket, a cover plate, a circuit board and a radiator; the secondary projecting system includes a lens bracket, a lens and a lens collar for connecting the lens with the lens bracket, and the lens bracket is connected with the mounting bracket;

the primary optical element is divided into an upper-layer optical element and a lower-layer optical element, the upper-layer optical element and the lower-layer optical element are each provided with light guiding bodies, and the light guiding bodies correspond to one light source; and the mounting bracket is provided with two rows of rectangular holes, and the light guiding bodies can be inserted into the rectangular holes.

More specifically, the left-right positioning limiting structure and the front-back positioning limiting structure include at least one row of rectangular holes formed in the mounting bracket and a positioning rib arranged in a wedge-shaped gap between each two adjacent light guiding bodies, each rectangular hole is provided with a connecting rib in the left-right direction, the rectangular holes correspond to the light guiding bodies one to one, and the light guiding bodies are inserted into the rectangular holes and the positioning ribs abut against the connecting ribs so as to limit the freedom degree of the primary optical element in the left-right direction and limit backward movement of the primary optical element;

the up-down positioning limiting structure includes a groove formed on the lower surface of the cover plate and flanging protrusion structures arranged at the upper portion and the lower portion of the front end of the primary optical element, the light guiding bodies are inserted into the rectangular holes, the flanging protrusion structure at the upper portion of the front end of the primary optical element is inserted into the groove, and the flanging protrusion structure at the lower portion of the front end of the primary optical element abuts against the upper surface of a horizontally extending platform structure on the mounting bracket so as to limit the freedom degree of the primary optical element in the up-down direction; and the horizontally extending platform structure on the mounting bracket limits forward movement of the primary optical element.

Further, on the basis of the above-mentioned technical solutions of the present disclosure, the present disclosure also provides a vehicle lamp. The vehicle lamp is provided with the mounting structure of a primary optical element for a vehicle headlamp according to any one of the above-mentioned technical solutions.

In addition, the present disclosure further provides a vehicle. The vehicle is provided with the vehicle lamp according to the above-mentioned technical solution.

By the above-mentioned technical solutions, the mounting structure of a primary optical element for a vehicle headlamp of the present disclosure includes the primary optical element, the mounting bracket for mounting the primary optical element and the cover plate connected with the mounting bracket; the positioning limiting structure for limiting the freedom degree of the primary optical element is arranged on the primary optical element, the mounting bracket and the cover plate; and the positioning limiting structure includes: the up-down positioning limiting structure, the up-down positioning limiting structure being arranged on the primary optical element, the mounting bracket and the cover plate so as to facilitate mounting and positioning of the primary optical element and limiting the freedom degree of the primary optical element in the up-down direction; and the left-right positioning limiting structure and the front-back positioning limiting structure, the left-right positioning limiting structure and the front-back positioning limiting structure being arranged on the primary optical element and the mounting bracket so as to facilitate mounting and positioning of the primary optical element and limiting the freedom degrees of the primary optical element in the front-back direction and the left-right direction. According to the present disclosure, the positioning limiting structures in the front-back direction and the left-right direction are formed by the positioning ribs between every two light guiding bodies on the primary optical element and the positioning pins on the mounting bracket, and then the cover plate is utilized to form the positioning limiting structure in the up-down direction for the primary optical element; and the positioning limiting structure of the present disclosure effectively ensures that the primary optical element has few attachment structures, the influence on light distribution performance of light is small, the installation stability of the primary optical element can be effectively ensured and normal use of the primary optical element is ensured.

BRIEF DESCRIPTION OF THE SYMBOLS

Figure 1:
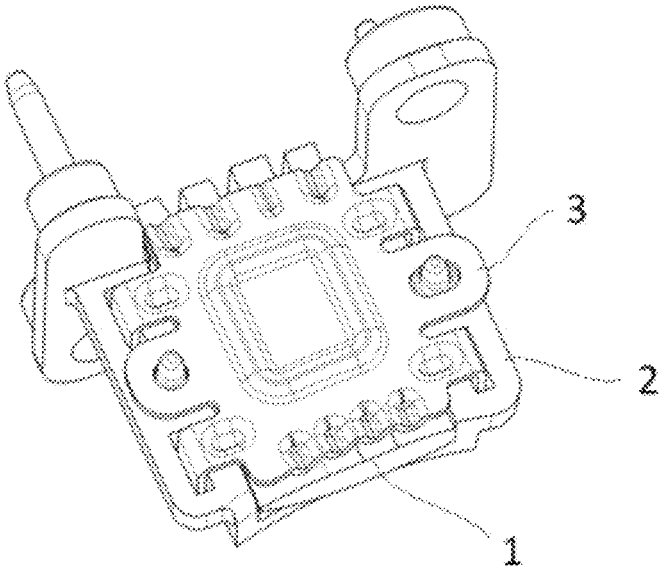
FIG. 1 is a stereoscopic structural schematic diagram of a mounting structure of a primary optical element for a vehicle headlamp according to a first embodiment of the present disclosure.

| | |
|---|---|
| 1. primary optical element, | 101. positioning rib, |
| 102. light guiding body, | 103. wedge-shaped gap, |
| 104. flanging protrusion structure, | 2. mounting bracket, |
| 201. mounting bracket rear positioning face, | 202. rear positioning pin, |
| 203. mounting bracket front positioning face | 204. mounting bracket positioning pin, |
| 205. circuit board positioning pin, | 206. buckle matching hole, |
| 207. matching clamping groove structure, | 208. cover plate mounting hole, |
| 209. connecting rib, | 3. cover plate, |
| 301. cover plate rear positioning face, | 302. cover plate front positioning face, |
| 303. cover plate positioning hole, | 304. buckle, |
| 305. boss, | 306. cover plate fixing hole, |
| 4. circuit board, | 401. circuit board positioning hole, |
| 5. radiator, | 501. radiator positioning hole, |
| 6. mounting screw, | 7. inner lamp lens, |
| 8. lens bracket, | 9. lens, |
| 10. lens collar. | |

DETAILED DESCRIPTION OF THE EMBODIMENTS

Hereunder the specific embodiments of the present disclosure will be illustrated in detail in connection with the accompanying drawings. It should be understood that the specific embodiments described here are only used for illustrating and explaining the present disclosure, but not used for limiting the present disclosure.

Firstly, it should be noted that in the description below, in order to clearly illustrate the technical solutions of the present disclosure, some related location words, e.g., "rear", "front" and the like, are all of meaning analogized according to the orientations indicated by a light emergent path, and for example, by taking a primary optical element as an example, the end, close to a light source, of the primary optical element is the rear end, while the end away from the light source is the front end; and it also can be understood that the end where the light enters is the rear end, and the end where the light emerges is the front end. In addition, in order to facilitate illustration, "X", "Y" and "Z" mentioned in the present disclosure represent meaning analogized according to the orientations normally indicated in the using process of a vehicle, and according to description of engineering technical personnel in the vehicle industry on the overall orientation of the vehicle, an X direction represents a front-back direction of the vehicle in normal use, a Y direction represents a left-right direction of the vehicle in normal use, and a Z direction represents an up-down direction of the vehicle in normal use.

In the description of the present disclosure, it should be noted that unless expressly stipulated or defined, terms "installed" and "connected" should be broadly understood, for example, "connected" may be fixedly connected, detachably connected, or integrally connected, and may be directly connected, indirectly connected by a medium, internally communicated between two elements or interacted with each other between two elements. Those ordinarily skilled in the art can understand specific meanings of the terms in the present disclosure according to specific conditions.

Figure 2:
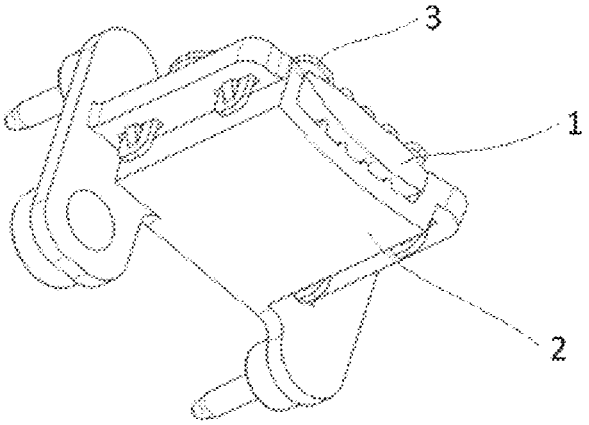
FIG. 2 is a stereoscopic structural schematic diagram of the mounting structure of a primary optical element for a vehicle headlamp according to the first embodiment of the present disclosure.

With reference to FIG. 1 and FIG. 2, a mounting structure of a primary optical element for a vehicle headlamp according to the present disclosure includes a primary optical element 1, a mounting bracket 2 for mounting the primary optical element 1 and a cover plate 3 connected with the mounting bracket 2, wherein a positioning limiting structure for limiting a freedom degree of the primary optical element 1 is arranged on the primary optical element 1, the mounting bracket 2 and the cover plate 3, and the positioning limiting structure includes: an up-down positioning limiting structure, the up-down positioning limiting structure being arranged on the primary optical element 1, the mounting bracket 2 and the cover plate 3 so as to facilitate mounting and positioning of the primary optical element 1 and limiting a freedom degree of the primary optical element 1 in an up-down direction Z; and a left-right positioning limiting structure and a front-back positioning limiting structure, the left-right positioning limiting structure and the front-back positioning limiting structure being arranged on the primary optical element 1 and the mounting bracket 2 so as to facilitate mounting and positioning of the primary optical element 1 and limiting freedom degrees of the primary optical element 1 in a front-back direction X and a left-right direction Y.

As one specific structure form of the present disclosure, the up-down positioning limiting structure includes a plurality of light guiding bodies 2 arranged at the rear end of the primary optical element 1, mounting bracket rear positioning faces 201 arranged at the rear end of the mounting bracket 2, mounting bracket front positioning faces 203 arranged at the front end of the mounting bracket 2, cover plate rear positioning faces 301 arranged at the rear portion of the cover plate 3 and cover plate front positioning faces 302 arranged at the front portion of the cover plate 3, the cover plate rear positioning faces 301 and the cover plate front positioning faces 302 are arranged on the same plane, the mounting bracket front positioning faces 203 and the mounting bracket rear positioning faces 201 are arranged on the same plane, the lower surfaces of the front portions of the light guiding bodies 102 abut against the mounting bracket front positioning faces 203, the lower surfaces of the rear portions of the light guiding bodies 102 abut against the mounting bracket rear positioning faces 201, the cover plate front positioning faces 302 abut against the upper surfaces of the front portions of the light guiding bodies 102, and the cover plate rear positioning faces 301 abut against the upper surfaces of the rear portions of the light guiding bodies 102 so as to limit the freedom degree of the primary optical element 1 in the up-down direction Z.

In such a structure, only the accuracy of four planes, i.e., the mounting bracket rear positioning face 201, the mounting bracket front positioning face 203, the cover plate rear positioning face 301 and the cover plate front positioning face 302, is required, the requirement on the accuracy of the rest of portions is low, such design not only can simplify production processes of the mounting bracket 2 and the cover plate 3, but also can reduce production cost, and meanwhile, even though the requirement on the accuracy of the four positioning faces is higher, it is also achievable. When the accuracy of each positioning face is improved, correspondingly, the positioning accuracy of the primary optical element 1 is also improved, and light passing through the primary optical element 1 can more accurately achieve expected effects, so that the scrap rate of parts is reduced, and production cost is reduced.

As one optional structure form of the specific structure form, the up-down positioning limiting structure includes a plurality of bosses 305 arranged on the surface of the cover plate 3 close to the primary optical element 1, the bosses 305 abut against one surface of the primary optical element 1, and the other surface of the primary optical element 1 abuts against the mounting bracket 2 so as to limit the freedom degree of the primary optical element 1 in the up-down direction Z.

Figure 11:
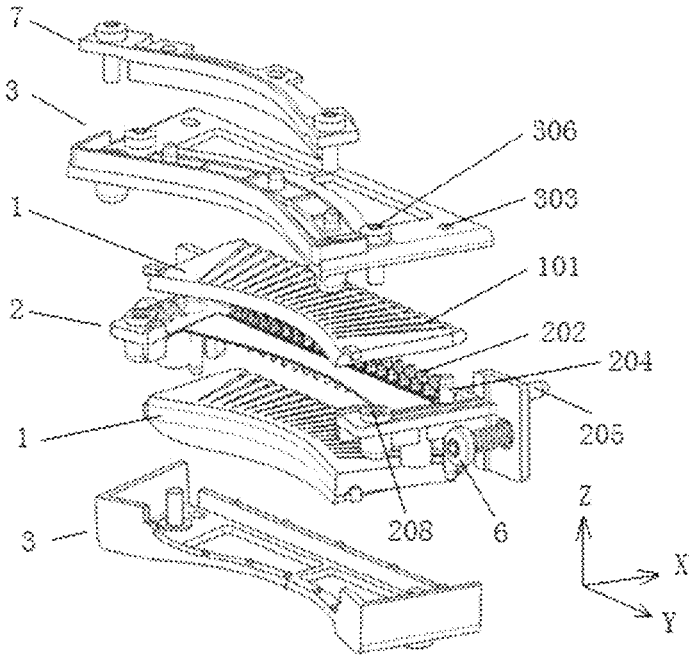
FIG. 11 is an exploded schematic diagram of an overall structure according to a second specific embodiment of the present disclosure.
Figure 12:
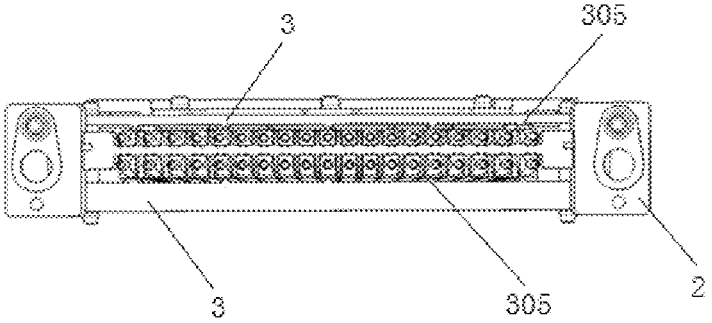
FIG. 12 is a structural schematic diagram of the rear end according to the second specific embodiment of the present disclosure.

As shown in FIG. 11 and FIG. 12, in such a structure, a plurality of bosses 305 are arranged on the surface of the cover plate 3 close to the primary optical element 1, the plurality of bosses 305 are in partial contact with the surface of the primary optical element 1, and the requirement on the machining accuracy of a partially positioned part at a positioning position is high, while the machining requirement at a non-positioning position can be reduced, and thus, by replacing overall contact with partial contact, machining cost can be reduced, and when an actual product has a problem of improper positioning and needs to be troubleshot, the troubleshooting difficulty can be reduced, uncertain variables are reduced and the mounting structure is convenient to repair and convenient to maintain.

As another optional structure form, the up-down positioning limiting structure includes a mounting groove formed on the mounting bracket 2, and the primary optical element 1 is arranged in the mounting groove and positioned between the mounting bracket 2 and the cover plate 3 so as to limit the freedom degree of the primary optical element 1 in the up-down direction Z.

Figure 14:
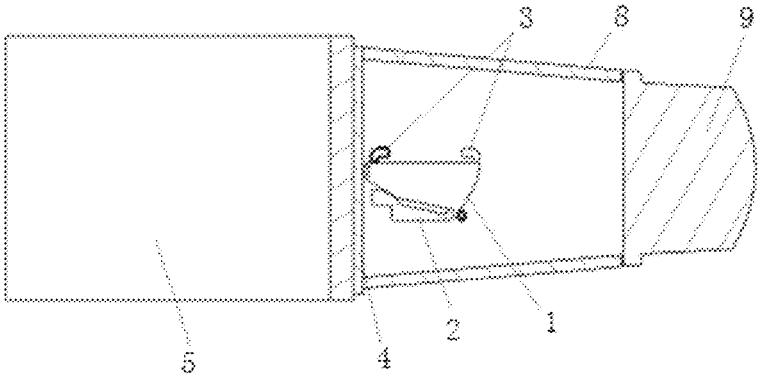
FIG. 14 is a sectional structural schematic diagram of a third specific embodiment of the present disclosure.
Figure 15:
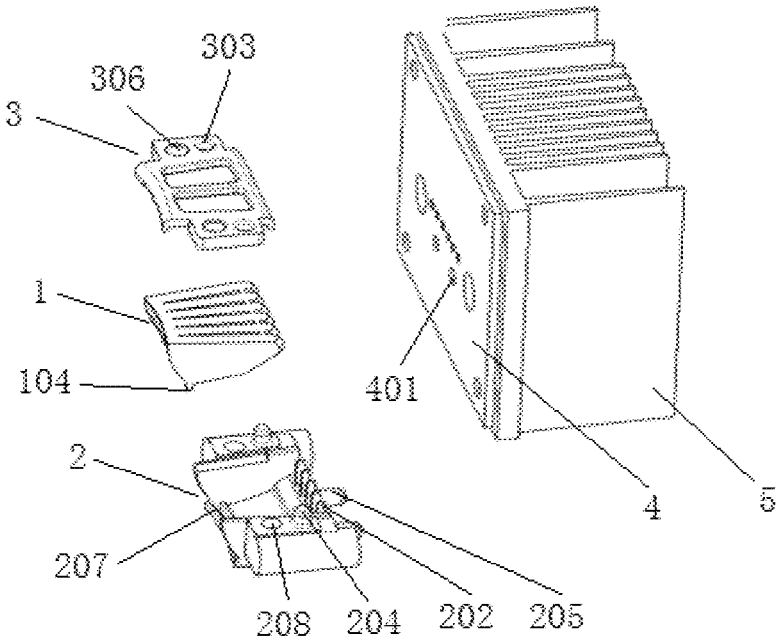
FIG. 15 is an exploded schematic diagram of an overall structure according to the third specific embodiment of the present disclosure.
Figure 16:
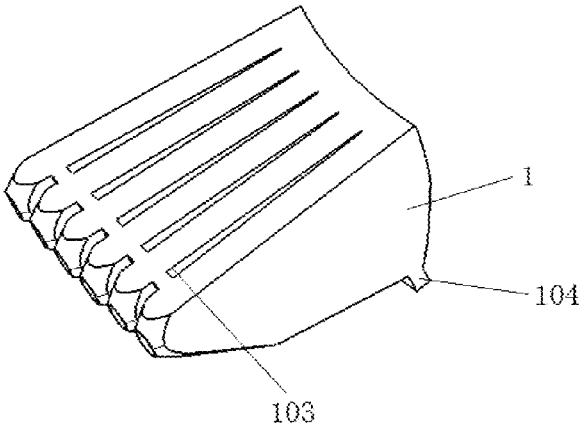
FIG. 16 is a structural schematic diagram of a primary optical element according to the third specific embodiment of the present disclosure.
Figure 17:
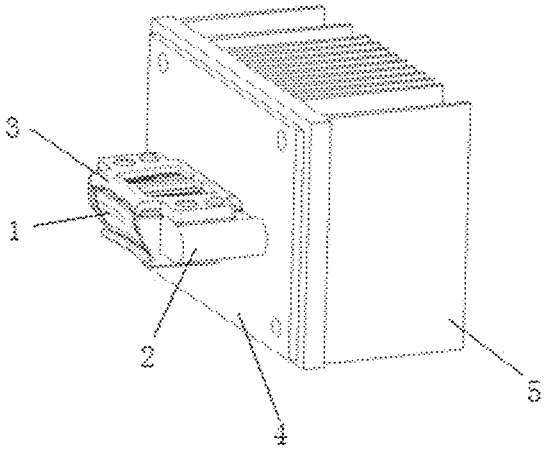
FIG. 17 is a structural schematic diagram of the third specific embodiment of the present disclosure.
Figure 18:
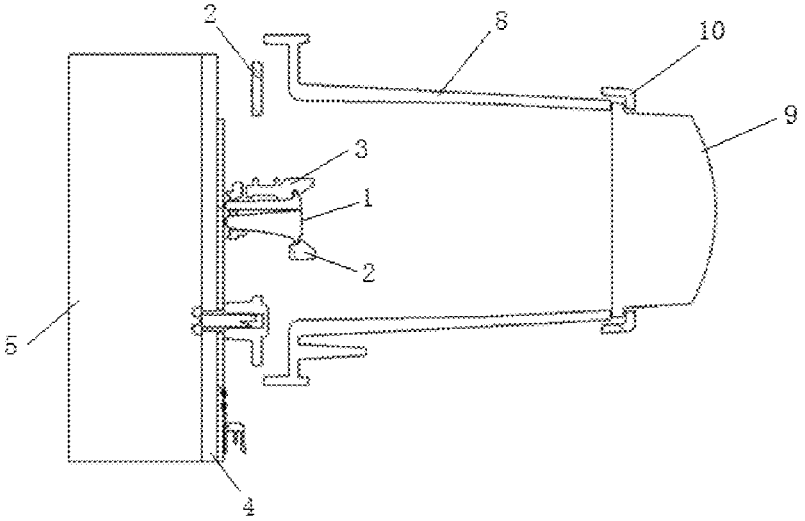
FIG. 18 is a schematic diagram of an overall structure according to a fourth specific embodiment of the present disclosure.
Figure 19:
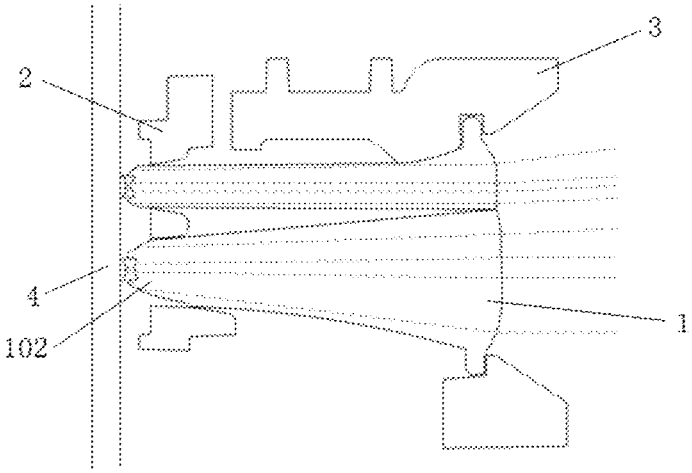
FIG. 19 is a sectional structural schematic diagram of the fourth specific embodiment of the present disclosure.
Figure 20:
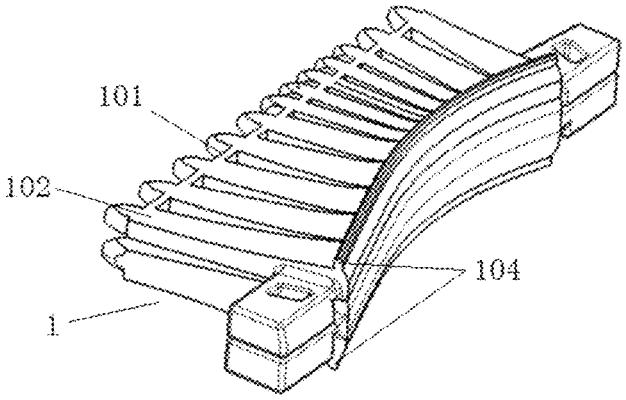
FIG. 20 is a structural schematic diagram of a primary optical element according to the fourth specific embodiment of the present disclosure.

As shown in FIG. 14 to FIG. 16, in such a structure, the mounting groove for mounting the primary optical element 1 is formed on the mounting bracket 2, two sides of the mounting groove may be in contact with the left and right sides of the primary optical element 1 so as to limit movement of the primary optical element in the left-right direction Y. Meanwhile, the lower surface of the cover plate 3 is in contact with the upper surface of the primary optical element 1, and the cover plate 3 is connected with the mounting bracket 2, so that movement of the primary optical element 1 in the up-down direction Z can be limited. Such a structure can reduce unnecessary parts or portions for limiting movement of the primary optical element 1, the structure is relatively compact, the limiting effect is good, and the primary optical element 1 is difficult to move in the using process.

Figure 3:
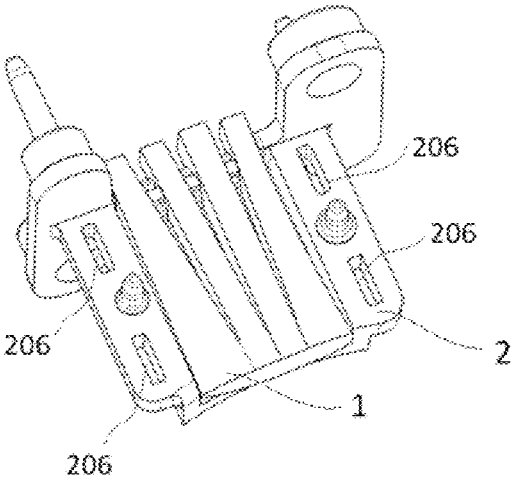
FIG. 3 is a stereoscopic structural schematic diagram of a primary optical element and a mounting bracket according to the first embodiment of the present disclosure.
Figure 4:
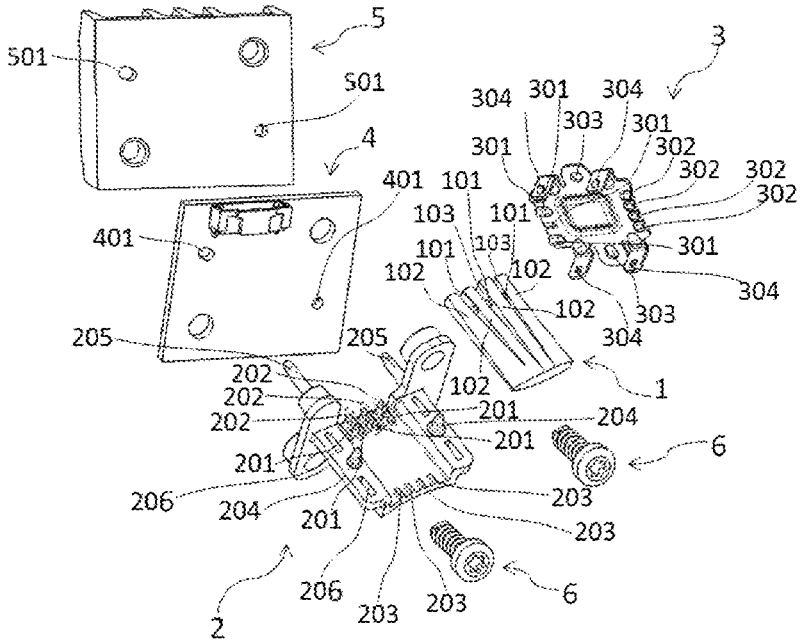
FIG. 4 is an exploded schematic diagram of an overall structure according to the first embodiment of the present disclosure.
Figure 5:
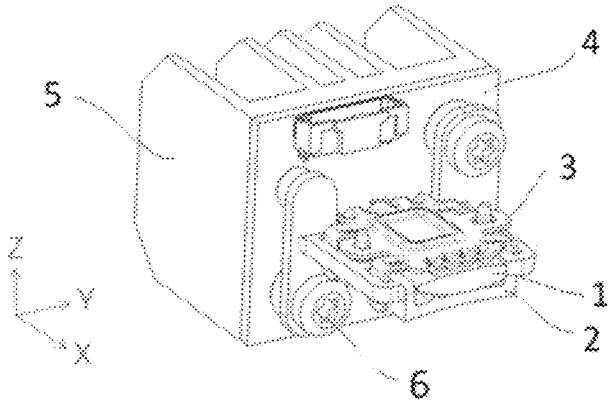
FIG. 5 is a stereoscopic structural schematic diagram of the overall structure according to the first embodiment of the present disclosure.
Figure 6:
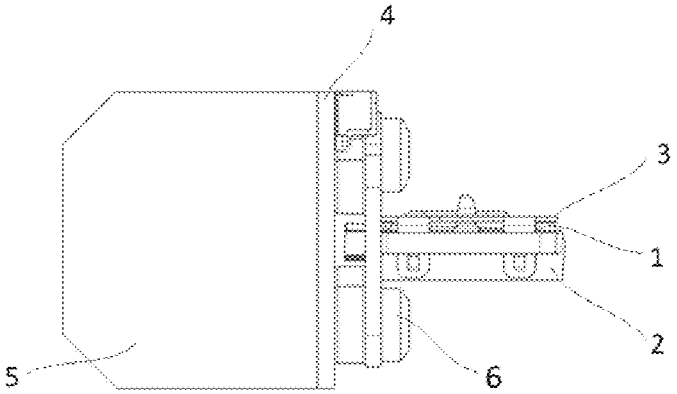
FIG. 6 is a right view of the overall structure according to the first embodiment of the present disclosure.
Figure 7:
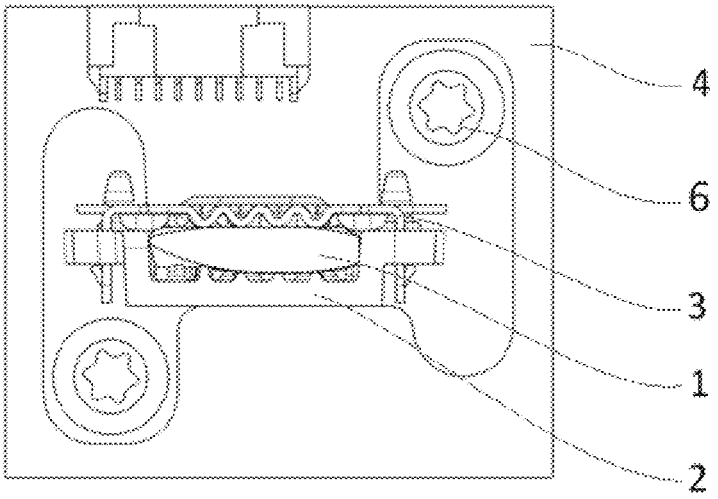
FIG. 7 is a front view of the overall structure according to the first embodiment of the present disclosure.
Figure 8:
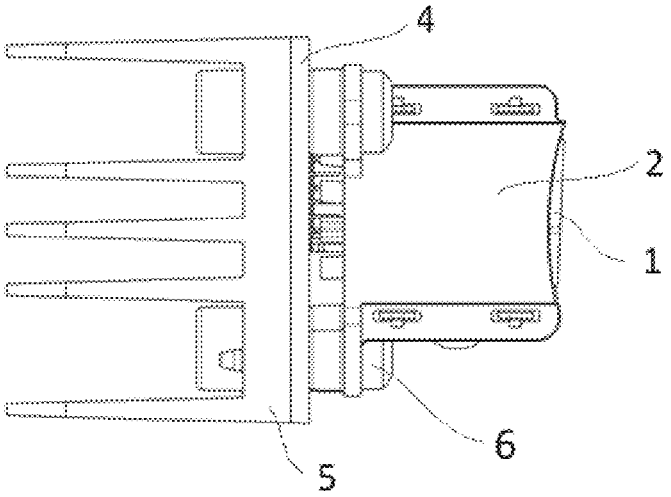
FIG. 8 is a bottom view of the overall structure according to the first embodiment of the present disclosure.
Figure 9:
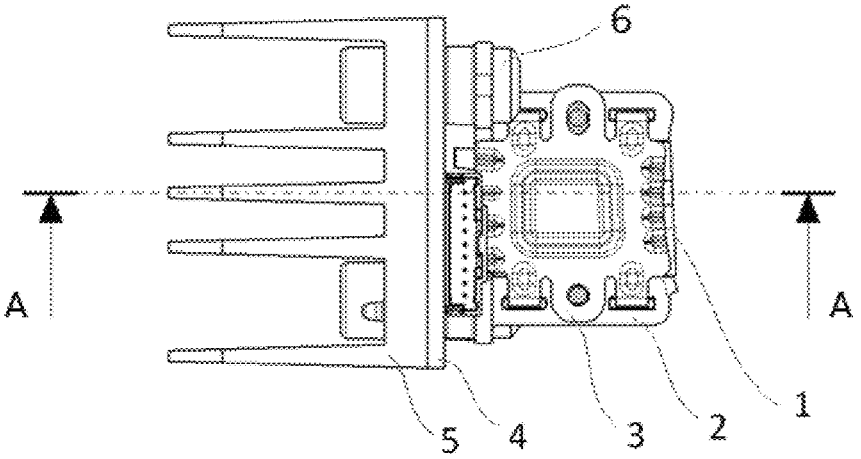
FIG. 9 is a top view of the overall structure according to the first embodiment of the present disclosure.
Figure 10:
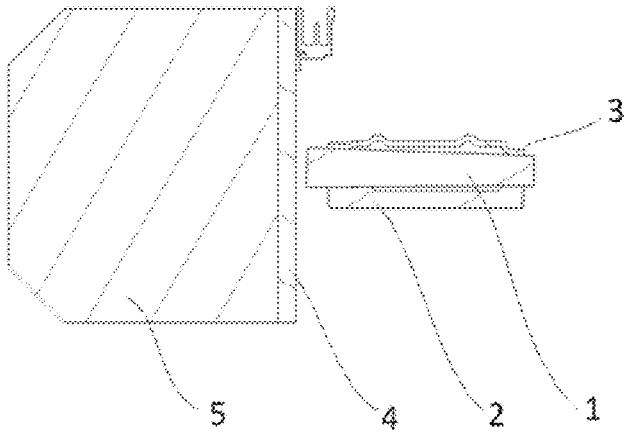
FIG. 10 is a structural schematic diagram of an A-A section of the overall structure according to the first embodiment of the present disclosure.

As another specific structure form of the present disclosure, as shown in FIG. 3 and FIG. 4, according to the primary optical element 1 of the present disclosure, a wedge-shaped gap 103 is formed between each two adjacent light guiding bodies 102 from the rear end to the front end, and the mounting bracket rear positioning faces 201 correspond to the wedge-shaped gaps 103 one to one; and the front ends of the light guiding bodies 102 are connected into one whole body, and a positioning rib 101 is arranged or integrally formed in the wedge-shaped gap 103 between each two adjacent light guiding bodies 102. The left-right positioning limiting structure and the front-back positioning limiting structure include two rear positioning pins 202 arranged on each mounting bracket rear positioning face 201 and in the front-back direction, gaps between every two rear positioning pins 202 arranged in the front-back direction correspond to the positioning ribs 101 one to one, and the positioning ribs 101 are clamped between the two corresponding rear positioning pins 202 and abut against the two corresponding rear positioning pins 202 so as to limit the freedom degree of the primary optical element 1 in the front-back direction X; and two opposite faces of each two adjacent light guiding bodies 102 abut against the corresponding rear positioning pins 202 so as to limit the freedom degree of the primary optical element 1 in the left-right direction Y.

It should be noted herein that for the primary optical element 1, any one part or structure for installation and positioning, which is arranged on the primary optical element 1, can generate influences on a light distributing effect of light more or less, and these influences commonly are negative, and thus, the parts or structures for installation and positioning on the primary optical element 1 should be reduced to the greatest extent. According to the mounting structure of a primary optical element for a vehicle headlamp, which is provided by the present disclosure, by arranging or integrally forming the positioning rib 101 in the wedge-shaped gap 103 between two adjacent light guiding bodies 102 and clamping the positioning rib 101 between the rear positioning pins 202 on the mounting bracket 2, a plurality of such repeated structures can simultaneously carry out positioning and limiting on the front-back freedom degree and the left-right freedom degree of the primary optical element 1 without adding other structures, so that the influences of the parts or structures for installation and positioning on the light incident to the primary optical element 1 are reduced to the greatest extent, optical efficiency is improved, and light stability is enhanced.

Figure 13:
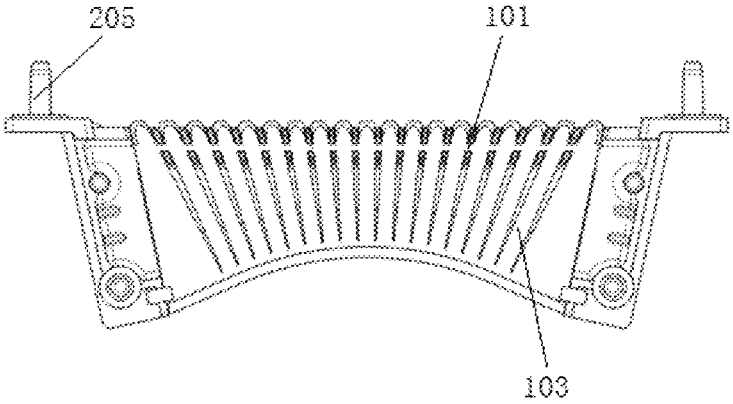
FIG. 13 is a structural schematic diagram of the upper side according to the second specific embodiment of the present disclosure.

As one optional structure form of the specific structure form, as shown in FIG. 11 and FIG. 13, two rows of rear positioning pins 202 are arranged on the upper surface and/or the lower surface of the rear portion of the mounting bracket 2, two front-back adjacent rear positioning pins 202 are arranged in the front-back direction X, gaps between every two rear positioning pins 202 arranged in the front-back direction X correspond to the positioning ribs 101 one to one, and the positioning ribs 101 are clamped between the two corresponding rear positioning pins 202 and abut against the two corresponding rear positioning pins 202 so as to limit the freedom degree of the primary optical element 1 in the front-back direction X; and two opposite faces of each two adjacent light guiding bodies 102 abut against the corresponding rear positioning pins 202 so as to limit the freedom degree of the primary optical element 1 in the left-right direction Y.

In a second specific embodiment as shown in FIG. 11 to FIG. 13, the primary optical element 1 includes an upper primary optical element and a lower primary optical element, the cover plate 3 includes an upper cover plate and a lower cover plate, the upper primary optical element and the upper cover plate for limiting the upper primary optical element in the up-down direction Z are sequentially installed on the upper side of the mounting bracket 2 from bottom to top, an inner lamp lens 7 is installed on the upper side of the upper cover plate, and the lower primary optical element and the lower cover plate for limiting the lower primary optical element in the up-down direction Z are sequentially installed on the lower side of the mounting bracket 2 from top to bottom; and the upper primary optical element and the lower primary optical element each include a plurality of light guiding bodies 102, wherein the light emergent ends of the light guiding bodies 102 of the upper primary optical element are connected with each other to form an upper light emergent surface, the light emergent ends of the light guiding bodies 102 of the lower primary optical element are connected with each other to form a lower light emergent surface, a light incident surface of the inner lamp lens 7 corresponds to the upper light emergent surface, and the bottom of the inner lamp lens 7 is positioned within a height range of the upper light emergent surface.

The primary optical element 1 is preferably made of a transparent silica gel material, and in order to solve problems of inconvenience in installation and positioning inaccuracy of the primary optical element 1 made of the silica gel material, the front-back and left-right directions of the primary optical element 1 can be limited by the left-right positioning limiting structure and the front-back positioning limiting structure, and the up-down direction of the primary optical element 1 is limited by the cover plate 3, so that the primary optical element 1 can be subjected to omnibearing positioning, and the primary optical element 1 is more convenient to install and more accurate to position. By inserting each positioning rib 101 in the gap between two corresponding rear positioning pins 202, the front-back direction X of the primary optical element 1 can be limited, and by abutting two opposite surfaces of each two adjacent light guiding bodies 102 against the corresponding rear positioning pin 202, the freedom degree of the primary optical element 1 in the left-right direction Y can be limited, so that it is accurate to position, and relative positions between the light incident ends of the light guiding bodies 102 of the primary optical element 1 and the light source and a position relationship among the light guiding bodies 102 are effectively ensured, and thus, it is difficult to generate excessive optical efficiency loss caused by positioning inaccuracy and light pattern distortion caused by deformation of the primary optical element 1. In addition, conventional front-back pressing-in installation of the primary optical element 1 is changed into up-down pressing-in installation, so that an installation stroke is effectively reduced, it is more aligned with structural characteristics of the primary optical element 1, and the primary optical element 1 is more convenient to install.

As another optional structure form of the specific structure form, as shown in FIG. 15, a row of rear positioning pins 202 are arranged at the rear portion of the mounting bracket 2 in the left-right direction Y, a matching clamping groove structure 207 is arranged at the front portion of the mounting bracket 2, the matching clamping groove structure 207 is in buckled connection with a flanging protrusion structure 104 arranged at the front portion of the primary optical element 1, and the rear positioning pins 202 are inserted into the wedge-shaped gaps 103 so as to limit the freedom degrees of the primary optical element 1 in the left-right direction Y and the front-back direction X.

In a third specific embodiment as shown in FIG. 14 to FIG. 17, the primary optical element 1 is arranged in an accommodating cavity defined by a circuit board 4, a lens bracket 8 and a lens 9 with a grid-shaped structure, a radiator 5 is arranged at the rear end of the circuit board 4, and the primary optical element 1 is installed at the front end of the circuit board 4.

The mounting bracket 2 is provided with a mounting groove for mounting the primary optical element 1, the primary optical element 1 is positioned between the mounting bracket 2 and the cover plate 3, mounting strips are symmetrically arranged on the left and right sides of the mounting groove, and the mounting strips are connected with mounting structures on the left and right sides of the cover plate 3 together. A matching clamping groove structure 207 is arranged at the front portion of the mounting groove, a flanging protrusion structure 104 is arranged at a corresponding position at the front portion of the primary optical element 1, and the flanging protrusion structure 104 is inserted into the matching clamping groove structure 207, so that not only can the primary optical element 1 be positioned, but also the freedom degree of the primary optical element 1 in the front-back direction X can be limited. Cooperatively, the rear positioning pins 202 are inserted into the wedge-shaped gaps 103, so that the freedom degrees of the primary optical element 1 in the front-back direction X and the left-and-rear direction Y can be limited.

More specifically, the rear positioning pin 202 is of a cone frustum structure or a pyramid frustum structure of which the sectional area of an upper portion is smaller than the sectional area of a lower portion, and a backstop structure is arranged on the surface of each rear positioning pin 202 abutting against the positioning rib 101. The structure of the rear positioning pin 202, of which the upper portion is small and the lower portion is big, can make the upper portion of the gap between the two rear positioning pins 202 big and make the lower portion of the gap small so as to benefit installation of the positioning rib 101, and meanwhile, the backstop structure can ensure that the positioning rib 101 is relatively fixed in mounting position and is difficult to shift in the normal using process, so as to ensure the stability of optical performance of the primary optical element 1.

In FIG. 4, as one preferred embodiment of the present disclosure, mounting bracket positioning pins 204 and buckle matching holes 206 are disposed on the left and right sides of the mounting bracket 2, cover plate positioning holes 303 and buckles 304 are disposed on the left and right sides of the cover plate 3, and the mounting bracket positioning pins 204 correspond to the cover plate positioning holes 303 one to one, and the buckle matching holes 206 correspond to the buckles 304 one to one.

Optionally, mounting bracket positioning pins 204 and cover plate mounting holes 208 are disposed on the left and right sides of the mounting bracket 2, cover plate positioning holes 303 and cover plate fixing holes 306 are formed in the left and right sides of the cover plate 3, and the mounting bracket positioning pins 204 correspond to the cover plate positioning holes 303 one to one, and the cover plate mounting holes 208 correspond to the cover plate fixing holes 306 one to one.

As shown in FIG. 11 and FIG. 14, the mounting bracket positioning pins 204 of the mounting bracket 2 are inserted into the cover plate positioning holes 303 to carry out accurate positioning on a mounting position of the cover plate 3, then the cover plate mounting holes 208 correspond to the cover plate fixing holes 306 one to one, and the mounting bracket 2 and the cover plate 3 can be connected together by fasteners such as screws, bolts and the like.

More preferably, the mounting bracket positioning pin 204 is of a cylinder structure or a cone frustum structure or a cuboid structure or a pyramid frustum structure.

In a fourth specific embodiment of the present disclosure, as shown in FIG. 18 to FIG. 21, the mounting structure includes a primary optical system and a secondary projecting system; the primary optical system includes a primary optical element 1, a mounting bracket 2, a cover plate 3, a circuit board 4 and a radiator 5; the secondary projecting system includes a lens bracket 8, a lens 9 and a lens collar 10 for connecting the lens 9 with the lens bracket 8, and the lens bracket 8 is connected with the mounting bracket 2; the primary optical element 1 is divided into an upper-layer optical element and a lower-layer optical element, the upper-layer optical element and the lower-layer optical element are each provided with light guiding bodies 102, and the light guiding bodies 102 correspond to one light source; and the mounting bracket 2 is provided with two rows of rectangular holes, and the light guiding bodies 102 can be inserted into the rectangular holes.

The left-right positioning limiting structure and the front-back positioning limiting structure include at least one row of rectangular holes formed in the mounting bracket 2 and a positioning rib 101 arranged in a wedge-shaped gap 103 between each two adjacent light guiding bodies 102, each rectangular hole is provided with a connecting rib 209 in the left-right direction Y, the rectangular holes correspond to the light guiding bodies 102 one to one, and the light guiding bodies 102 are inserted into the rectangular holes and the positioning ribs 101 abut against the connecting ribs 209 so as to limit the freedom degree of the primary optical element 1 in the left-right direction and limit backward movement of the primary optical element; and the up-down positioning limiting structure includes a groove formed on the lower surface of the cover plate 3 and flanging protrusion structures 104 arranged at the upper portion and the lower portion of the front end of the primary optical element 1, the light guiding bodies 102 are inserted into the rectangular holes, the flanging protrusion structure 104 at the upper portion of the front end of the primary optical element 1 is inserted into the groove, and the flanging protrusion structure 104 at the lower portion of the front end of the primary optical element 1 abuts against the upper surface of a horizontally extending platform structure on the mounting bracket 2 so as to limit the freedom degree of the primary optical element 1 in the up-down direction. Meanwhile, the horizontally extending platform structure on the mounting bracket 2 limits forward movement of the primary optical element 1.

In the figures, the primary optical element 1 of the present disclosure is provided with two rows of light guiding bodies 102, the positioning rib 101 is formed between each two light guiding bodies 102 which are adjacent in the left-right direction, the positioning ribs 101 not only can make connection among the light guiding bodies 102 firmer, but also can take an effect on positioning and fixing of the primary optical element 11, the light guiding bodies 102 are inserted into the corresponding rectangular holes, and the positioning ribs 101 abut against the connecting ribs 209 between every two adjacent rectangular holes, so that the primary optical element 1 can be accurately positioned and it can be guaranteed that the primary optical element 1 does not move towards one end of the light source or move towards the up-down direction Z and the left-right direction Y in the using process. Meanwhile, by closely abutting the flanging protrusion structure 104 at the lower portion of the front end of the primary optical element 1 against the lateral surface of the horizontally extending platform structure on the mounting bracket 2, movement of the primary optical element 1 towards the side away from the light source can be limited, and finally, by connecting the cover plate 3 with the mounting bracket 2 together, the freedom degrees of the primary optical element 1 in the front-back direction X, the left-right direction Y and the up-down direction Z can be limited.

Figure 21:
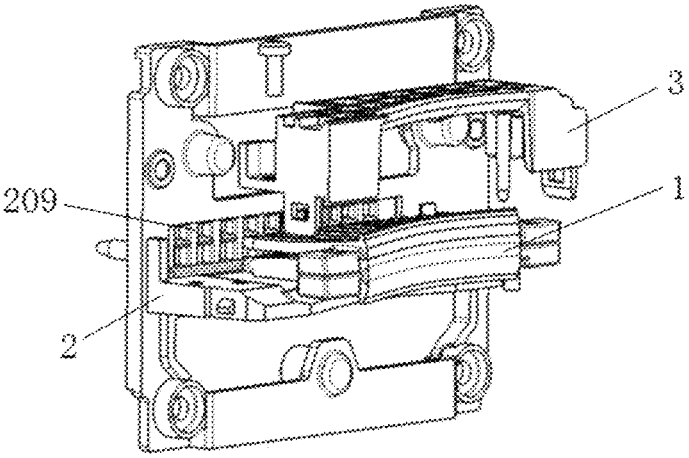
FIG. 21 is an exploded schematic diagram according to the fourth specific embodiment of the present disclosure.

It can be seen from FIG. 21 that in the fourth specific embodiment of the present disclosure, the mounting bracket 2 is provided with positioning holes, the cover plate 3 is provided with positioning pins, and the positioning pins on the cover plate 3 are inserted into the positioning holes in the mounting bracket 2 to meet the positioning requirement of the mounting bracket 2 and the cover plate 3. However, such a mounting structure may also be in other structure forms, for example, the mounting bracket 2 is provided with positioning pins and the cover plate 3 is provided with positioning holes, through which the positioning requirement can also be met, and the specific structure form can be changed according to actual demands of the mounting structure.

In FIG. 4 to FIG. 10, the mounting structure for a primary optical element for a vehicle headlamp of the present disclosure further includes a circuit board 4, a radiator 5 on which the circuit board 4 is installed and mounting screws 6, the circuit board 4 is provided with circuit board positioning holes 401, the radiator 5 is provided with radiator positioning holes 501, the mounting bracket 2 is provided with circuit board positioning pins 205, and the circuit board positioning pins 205 correspond to the circuit board positioning holes 401 and the radiator positioning holes 501 one to one; and the mounting screws 6 are adapted to fix the mounting bracket 2 and the circuit board 4 onto the radiator 5.

In the present disclosure, installation and positioning of the primary optical element 1 and installation of other related parts are illustrated as follows: firstly, the primary optical element 1 is installed on the mounting bracket 2, and each positioning rib 101 on the primary optical element 1 is clamped between two corresponding rear positioning pins 202 on the mounting bracket 2; and it should be noted that the positioning ribs 101 need to be clamped in place to go beyond the backstop structures, and after the primary optical element 1 is installed in place, if it is found that there are still big gaps between the positioning ribs 101 and two corresponding rear positioning pins 202, replacement needs to be carried out in time so as to avoid a case that due to the big gaps, the primary optical element 1 is instable in optical performance and rapid to wear in the using process. After the primary optical element 1 is installed in place, the left and right mounting bracket positioning pins 204 and the left and right cover plate positioning holes 303 in the cover plate 3 are correspondingly installed, and the buckle matching holes 206 and the buckles 304 are correspondingly installed so as to form a small assembly. At that time, the lower surfaces of the front portions of the light guiding bodies 102, (i.e., the lower surface of the front portion of the primary optical element 1) abut against the mounting bracket front positioning faces 203, the lower surfaces of the rear portions of the light guiding bodies 102 abut against the mounting bracket rear positioning faces 201, the cover plate front positioning faces 302 abut against the upper surfaces of the front portions of the light guiding bodies 102, and the cover plate rear positioning faces 301 abut against the upper surfaces of the rear portions of the light guiding bodies 102 so as to limit the freedom degree of the primary optical element 1 in the up-down direction. Similarly, if the planes cannot fully abut against each other and there is a certain gap therebetween, parts with proper sizes need to be reselected for reinstallation. Finally, this small assembly is connected with the circuit board 4 and the radiator 5 by the mounting screws 6 so as to form the mounting structure of a primary optical element for a vehicle headlamp of the present disclosure.

In addition, the present disclosure further provides a vehicle lamp. The vehicle lamp is provided with the mounting structure of a primary optical element for a vehicle headlamp according to any one of the above-mentioned technical solutions.

Further, the present disclosure further provides a vehicle. The vehicle includes the vehicle lamp according to the above-mentioned technical solution.

It can be seen from the description above that the mounting structure of a primary optical element for a vehicle headlamp of the present disclosure includes the primary optical element 1, the mounting bracket 2 for mounting the primary optical element 1 and the cover plate 3 connected with the mounting bracket 2; the positioning limiting structure for limiting the freedom degree of the primary optical element is arranged on the primary optical element 1, the mounting bracket 2 and the cover plate 3; and the positioning limiting structure includes: the up-down positioning limiting structure, the up-down positioning limiting structure being arranged on the primary optical element 1, the mounting bracket 2 and the cover plate 3 so as to facilitate mounting and positioning of the primary optical element 1 and limiting the freedom degree of the primary optical element 1 in the up-down direction; and the left-right positioning limiting structure and the front-back positioning limiting structure, the left-right positioning limiting structure and the front-back positioning limiting structure being arranged on the primary optical element 1 and the mounting bracket 2 so as to facilitate mounting and positioning of the primary optical element 1 and limiting the freedom degrees of the primary optical element 1 in the front-back direction and the left-right direction. According to the present disclosure, the positioning limiting structures in the front-back direction and the left-right direction are formed by the positioning ribs 101 between every two adjacent light guiding bodies 102 on the primary optical element 1 and the rear positioning pins 202 on the mounting bracket 2, and then the cover plate 3 is utilized to form the positioning limiting structure in the up-down direction for the primary optical element 1; and the positioning limiting structure of the present disclosure effectively ensures that the primary optical element 1 has few attachment structures, the influence on light distribution performance of light is small, the installation stability of the primary optical element can be effectively ensure and normal use of the primary optical element 1 is ensured.

The preferred embodiments of the present disclosure are described in detail above in connection with the accompanying drawings, but the present disclosure is not limited to the specific details in the embodiments above. Within the scope of the technical conception of the present disclosure, various simple variations can be made to the technical solutions of the present disclosure, and these simple variations all shall fall within the scope of the present disclosure.

Additionally, it should be noted that various specific technical characteristics described in the specific embodiments above, in a case of no conflicts, can be combined in any proper mode, and in order to avoid unnecessary repetition, various possible combination modes will not be additionally illustrated in the present disclosure.

In addition, various different embodiments of the present disclosure also can be randomly combined, and as long as they are not departed from the thought of the present disclosure, they also should be regarded as contents disclosed by the present disclosure.

The invention claimed is:

1. A mounting structure of a primary optical element for a vehicle headlamp, comprising a primary optical element, a mounting bracket for mounting the primary optical element and a cover plate connected with the mounting bracket, wherein a positioning limiting structure for limiting a freedom degree of the primary optical element is provided on the primary optical element, the mounting bracket and the cover plate, and the positioning limiting structure comprises:

an up-down positioning limiting structure, the up-down positioning limiting structure is provided on the primary optical element, the mounting bracket and the cover plate so as to facilitate mounting and positioning of the primary optical element and limiting a freedom degree of the primary optical element in an up-down direction (Z); and a left-right positioning limiting structure and a front-back positioning limiting structure, the left-right positioning limiting structure and the front-back positioning limiting structure are provided on the primary optical element and the mounting bracket so as to facilitate mounting and positioning of the primary optical element and limiting freedom degrees of the primary optical element in a front-back direction (X) and a left-right direction (Y);

wherein, the up-down positioning limiting structure comprises a plurality of light guiding bodies arranged at a rear end of the primary optical element, a mounting bracket rear positioning face arranged at a rear end of the mounting bracket, a mounting bracket front positioning face arranged at a front end of the mounting bracket, a cover plate rear positioning face arranged at a rear portion of the cover plate and a cover plate front positioning face arranged at a front portion of the cover plate, the cover plate rear positioning face and the cover plate front positioning face are arranged on the same plane, the mounting bracket front positioning face and the mounting bracket rear positioning face are arranged on the same plane, lower surfaces of front portions of the light guiding bodies abut against the mounting bracket front positioning face, lower surfaces of rear portions of the light guiding bodies abut against the mounting bracket rear positioning face, the cover plate front positioning face abuts against the upper surfaces of the front portions of the light guiding bodies, and the cover plate rear positioning face abuts against the upper surfaces of the rear portions of the light guiding bodies so as to limit the freedom degree of the primary optical element in the up-down direction (Z); or the up-down positioning limiting structure comprises a plurality of bosses arranged on one surface of the cover plate close to the primary optical element, the bosses abut against one surface of the primary optical element, and the other surface of the primary optical element abuts against the mounting bracket so as to limit the freedom degree of the primary optical element in the up-down direction (Z); or the up-down positioning limiting structure comprises a mounting groove formed on the mounting bracket, and the primary optical element is arranged in the mounting groove and positioned between the mounting bracket and the cover plate so as to limit the freedom degree of the primary optical element in the up-down direction (Z);

a wedge-shaped gap is formed between two adjacent light guiding bodies from the rear end to the front end, and the mounting bracket rear positioning face and the wedge-shaped dap are in one-to-one correspondence; the front ends of the light guiding bodies are connected into one whole body, and a positioning rib is arranged or integrally formed in the wedge-shaped gap between two adjacent light guiding bodies;

the left-right positioning limiting structure and the front-back positioning limiting structure comprise two rear positioning pins arranged on the mounting bracket rear positioning face, the two rear positioning pins are arranged in the front- back direction, a gap between the two rear positioning pins corresponds to the positioning rib one to one, and the positioning rib is clamped between the two rear positioning pins and abuts against the two rear positioning pins so as to limit the freedom degree of the primary optical element in the front-back direction (X); and two opposite faces of the two adjacent light guiding bodies abut against the rear positioning pins so as to limit the freedom degree of the primary optical element in the left-right direction (Y); or two rows of rear positioning pins are arranged on the upper surface and/or the lower surface of the rear portion of the mounting bracket, two front-back adjacent rear positioning pins are arranged in the front-back direction (X), a gap between the two rear positioning pins corresponds to the positioning rib one to one, and the positioning rib is clamped between the two rear positioning pins and abuts against the two rear positioning pins so as to limit the freedom degree of the primary optical element in the front-back direction (X); and two opposite faces of the two adjacent light guiding bodies abut against the rear positioning pins so as to limit the freedom degree of the primary optical element in the left-right direction (Y); or a row of rear positioning pins are arranged at the rear portion of the mounting bracket in the left-right direction (Y), a matching clamping groove structure is formed at the front portion of the mounting bracket, the matching clamping groove structure is in buckled connection with a flanging protrusion structure formed at the front portion of the primary optical element, and the rear positioning pins are inserted into the wedge-shaped gap so as to limit the freedom degrees of the primary optical element in the left-right direction (Y) and the front-back direction (X).

2. The mounting structure of a primary optical element for a vehicle headlamp according to claim 1, wherein, mounting bracket positioning pins and buckle matching holes are disposed on the left and right sides of the mounting bracket, cover plate positioning holes and buckles are disposed on the left and right sides of the cover plate, the mounting bracket positioning pins correspond to the cover plate positioning holes one to one, and the buckle matching holes correspond to the buckles one to one; or mounting bracket positioning pins and cover plate mounting holes are disposed on the left and right sides of the mounting bracket, cover plate positioning holes and cover plate fixing holes are formed in the left and right sides of the cover plate, the mounting bracket positioning pins correspond to the cover plate positioning holes one to one, and the cover plate mounting holes correspond to the cover plate fixing holes one to one.

3. The mounting structure of a primary optical element for a vehicle headlamp according to claim 1, wherein, the primary optical element comprises an upper primary optical element and a lower primary optical element, the cover plate comprises an upper cover plate and a lower cover plate, the upper primary optical element and the upper cover plate for limiting the upper primary optical element in the up-down direction (Z) are sequentially installed on the upper side of the mounting bracket from bottom to top, an inner lamp lens is installed on the upper side of the upper cover plate, and the lower primary optical element and the lower cover plate for limiting the lower primary optical element in the up-down direction (Z) are sequentially installed on the lower side of the mounting bracket from top to bottom; and the upper primary optical element and the lower primary optical element each comprise a plurality of light guiding bodies, wherein the light emergent ends of the light guiding bodies of the upper primary optical element are connected with each other to form an upper light emergent surface, the light emergent ends of the light guiding bodies of the lower primary optical element are connected with each other to form a lower light emergent surface, a light incident surface of the inner lamp lens corresponds to the upper light emergent surface, and the bottom of the inner lamp lens is positioned within a height range of the upper light emergent surface.

4. The mounting structure of a primary optical element for a vehicle headlamp according to claim 3, wherein, the up-down positioning limiting structure comprises a plurality of bosses formed on one surface of the cover plate close to the primary optical element, the bosses abut against one surface of the primary optical element, and the other surface of the primary optical element abuts against the mounting bracket so as to limit the freedom degree of the primary optical element in the up-down direction (Z).

5. The mounting structure of a primary optical element for a vehicle headlamp according to claim 4, wherein, two rows of rear positioning pins are arranged on the upper surface and/or the lower surface of the rear portion of the mounting bracket, two front-back adjacent rear positioning pins are arranged in the front-back direction (X), a gap between the two rear positioning pins corresponds to the positioning rib one to one, and the positioning rib is clamped between the two rear positioning pins and abuts against the two rear positioning pins so as to limit the freedom degree of the primary optical element in the front-back direction (X); and two opposite faces of the two adjacent light guiding bodies abut against the rear positioning pins so as to limit the freedom degree of the primary optical element in the left-right direction (Y).

6. The mounting structure of a primary optical element for a vehicle headlamp according to claim 1, wherein, the primary optical element is arranged in an accommodating cavity defined by a circuit board, a lens bracket and a lens with a grid-shaped structure, a radiator is arranged at the rear end of the circuit board, and the primary optical element is installed at the front end of the circuit board.

7. The mounting structure of a primary optical element for a vehicle headlamp according to claim 6, wherein, the up-down positioning limiting structure comprises a mounting groove formed on the mounting bracket, and the primary optical element is arranged in the mounting groove and positioned between the mounting bracket and the cover plate so as to limit the freedom degree of the primary optical element in the up-down direction (Z).

8. The mounting structure of a primary optical element for a vehicle headlamp according to claim 7, wherein, a row of rear positioning pins are arranged at the rear portion of the mounting bracket in the left-right direction (Y), a matching clamping groove structure is formed at the front portion of the mounting bracket, the matching clamping groove structure is in buckled connection with a flanging protrusion structure arranged at the front portion of the primary optical element, and the rear positioning pins are inserted into the wedge-shaped gap so as to limit the freedom degrees of the primary optical element in the left-right direction (Y) and the front-back direction (X).

9. The mounting structure of a primary optical element for a vehicle headlamp according to claim 1, wherein, comprising a primary optical system and a secondary projecting system, the primary optical system comprises the primary optical element, the mounting bracket, the cover plate, a circuit board and a radiator, the secondary projecting system comprises a lens bracket, a lens and a lens collar for connecting the lens with the lens bracket, and the lens bracket is connected with the mounting bracket;

the primary optical element is divided into an upper-layer optical element and a lower-layer optical element, the upper-layer optical element and the lower-layer optical element are each provided with light guiding bodies, and the light guiding bodies correspond to one light source; and the mounting bracket is provided with two rows of rectangular holes, and the light guiding bodies can be inserted into the rectangular holes.

10. The mounting structure of a primary optical element for a vehicle headlamp according to claim 9, wherein, the left-right positioning limiting structure and the front-back positioning limiting structure comprise at least one row of rectangular holes formed in the mounting bracket and a positioning rib arranged in a wedge-shaped gap between two adjacent light guiding bodies, each rectangular hole is provided with a connecting rib in the left-right direction (Y), the rectangular holes and the light guiding bodies are in one-to-one correspondence, and the light guiding bodies are inserted into the rectangular holes and the positioning rib abuts against the connecting ribs so as to limit the freedom degree of the primary optical element in the left-right direction (Y) and limit backward movement of the primary optical element;

the up-down positioning limiting structure comprises a groove formed on the lower surface of the cover plate and flanging protrusion structures arranged at the upper portion and the lower portion of the front end of the primary optical element, the light guiding bodies are inserted into the rectangular holes, the flanging protrusion structure at the upper portion of the front end of the primary optical element is inserted into the groove, and the flanging protrusion structure at the lower portion of the front end of the primary optical element abuts against the upper surface of a horizontally extending platform structure on the mounting bracket so as to limit the freedom degree of the primary optical element in the up-down direction (Z); and the horizontally extending platform structure on the mounting bracket limits forward movement of the primary optical element.

11. A vehicle lamp, comprising the mounting structure of a primary optical element for a vehicle headlamp according to claim 1.

12. The vehicle headlamp according to claim 11, wherein, the up-down positioning limiting structure comprises a plurality of light guiding bodies arranged at a rear end of the primary optical element, a mounting bracket rear positioning face arranged at a rear end of the mounting bracket, a mounting bracket front positioning face arranged at a front end of the mounting bracket, a cover plate rear positioning face arranged at a rear portion of the cover plate and a cover plate front positioning face arranged at a front portion of the cover plate, the cover plate rear positioning face and the cover plate front positioning face are arranged on the same plane, the mounting bracket front positioning face and the mounting bracket rear positioning face are arranged on the same plane, lower surfaces of front portions of the light guiding bodies abut against the mounting bracket front positioning face, lower surfaces of rear portions of the light guiding bodies abut against the mounting bracket rear positioning face, the cover plate front positioning face abuts against the upper surfaces of the front portions of the light guiding bodies, and the cover plate rear positioning face abuts against the upper surfaces of the rear portions of the light guiding bodies so as to limit the freedom degree of the primary optical element in the up-down direction (Z); or the up-down positioning limiting structure comprises a plurality of bosses arranged on one surface of the cover plate close to the primary optical element, the bosses abut against one surface of the primary optical element, and the other surface of the primary optical element abuts against the mounting bracket so as to limit the freedom degree of the primary optical element in the up-down direction (Z); or the up-down positioning limiting structure comprises a mounting groove formed on the mounting bracket, and the primary optical element is arranged in the mounting groove and positioned between the mounting bracket and the cover plate so as to limit the freedom degree of the primary optical element in the up-down direction (Z).

13. The vehicle headlamp according to claim 12, wherein, mounting bracket positioning pins and buckle matching holes are disposed on the left and right sides of the mounting bracket, cover plate positioning holes and buckles are disposed on the left and right sides of the cover plate, the mounting bracket positioning pins correspond to the cover plate positioning holes one to one, and the buckle matching holes correspond to the buckles one to one; or mounting bracket positioning pins and cover plate mounting holes are disposed on the left and right sides of the mounting bracket, cover plate positioning holes and cover plate fixing holes are formed in the left and right sides of the cover plate, the mounting bracket positioning pins correspond to the cover plate positioning holes one to one, and the cover plate mounting holes correspond to the cover plate fixing holes one to one.

14. The vehicle headlamp according to claim 11, wherein, the primary optical element comprises an upper primary optical element and a lower primary optical element, the cover plate comprises an upper cover plate and a lower cover plate, the upper primary optical element and the upper cover plate for limiting the upper primary optical element in the up-down direction (Z) are sequentially installed on the upper side of the mounting bracket from bottom to top, an inner lamp lens is installed on the upper side of the upper cover plate, and the lower primary optical element and the lower cover plate for limiting the lower primary optical element in the up-down direction (Z) are sequentially installed on the lower side of the mounting bracket from top to bottom; and the upper primary optical element and the lower primary optical element each comprise a plurality of light guiding bodies, wherein the light emergent ends of the light guiding bodies of the upper primary optical element are connected with each other to form an upper light emergent surface, the light emergent ends of the light guiding bodies of the lower primary optical element are connected with each other to form a lower light emergent surface, a light incident surface of the inner lamp lens corresponds to the upper light emergent surface, and the bottom of the inner lamp lens is positioned within a height range of the upper light emergent surface.

15. The vehicle headlamp according to claim 14, wherein, the up-down positioning limiting structure comprises a plurality of bosses formed on one surface of the cover plate close to the primary optical element, the bosses abut against one surface of the primary optical element, and the other surface of the primary optical element abuts against the mounting bracket so as to limit the freedom degree of the primary optical element in the up-down direction (Z).

16. The vehicle headlamp according to claim 15, wherein, two rows of rear positioning pins are arranged on the upper surface and/or the lower surface of the rear portion of the mounting bracket, two front-back adjacent rear positioning pins are arranged in the front-back direction (X), a gap between the two rear positioning pins corresponds to the positioning rib one to one, and the positioning rib is clamped between the two rear positioning pins and abuts against the two rear positioning pins so as to limit the freedom degree of the primary optical element in the front-back direction (X); and two opposite faces of the two adjacent light guiding bodies abut against the rear positioning pins so as to limit the freedom degree of the primary optical element in the left-right direction (Y).

17. The vehicle headlamp according to claim 11, wherein, the primary optical element is arranged in an accommodating cavity defined by a circuit board, a lens bracket and a lens with a grid-shaped structure, a radiator is arranged at the rear end of the circuit board, and the primary optical element is installed at the front end of the circuit board.

18. The vehicle headlamp according to claim 17, wherein, the up-down positioning limiting structure comprises a mounting groove formed on the mounting bracket, and the primary optical element is arranged in the mounting groove and positioned between the mounting bracket and the cover plate so as to limit the freedom degree of the primary optical element in the up-down direction (Z).

19. The vehicle headlamp according to claim 18, wherein, a row of rear positioning pins are arranged at the rear portion of the mounting bracket in the left-right direction (Y), a matching clamping groove structure is formed at the front portion of the mounting bracket, the matching clamping groove structure is in buckled connection with a flanging protrusion structure arranged at the front portion of the primary optical element, and the rear positioning pins are inserted into the wedge-shaped gap so as to limit the freedom degrees of the primary optical element in the left-right direction (Y) and the front-back direction (X).

20. The vehicle headlamp according to claim 11, wherein, comprising a primary optical system and a secondary projecting system, the primary optical system comprises the primary optical element, the mounting bracket, the cover plate, a circuit board and a radiator, the secondary projecting system comprises a lens bracket, a lens and a lens collar for connecting the lens with the lens bracket, and the lens bracket is connected with the mounting bracket;

the primary optical element is divided into an upper-layer optical element and a lower-layer optical element, the upper-layer optical element and the lower-layer optical element are each provided with light guiding bodies, and the light guiding bodies correspond to one light source; and the mounting bracket is provided with two rows of rectangular holes, and the light guiding bodies can be inserted into the rectangular holes.

21. The vehicle headlamp according to claim 20, wherein, the left-right positioning limiting structure and the front-back positioning limiting structure comprise at least one row of rectangular holes formed in the mounting bracket and a positioning rib arranged in a wedge-shaped gap between two adjacent light guiding bodies, each rectangular hole is provided with a connecting rib in the left-right direction (Y), the rectangular holes and the light guiding bodies are in one-to-one correspondence, and the light guiding bodies are inserted into the rectangular holes and the positioning rib abuts against the connecting ribs so as to limit the freedom degree of the primary optical element in the left-right direction (Y) and limit backward movement of the primary optical element;

the up-down positioning limiting structure comprises a groove formed on the lower surface of the cover plate and flanging protrusion structures arranged at the upper portion and the lower portion of the front end of the primary optical element, the light guiding bodies are inserted into the rectangular holes, the flanging protrusion structure at the upper portion of the front end of the primary optical element is inserted into the groove, and the flanging protrusion structure at the lower portion of the front end of the primary optical element abuts against the upper surface of a horizontally extending platform structure on the mounting bracket so as to limit the freedom degree of the primary optical element in the up-down direction (Z); and the horizontally extending platform structure on the mounting bracket limits forward movement of the primary optical element.

* * * * *